US007337724B2

(12) United States Patent
Sibum et al.

(10) Patent No.: US 7,337,724 B2
(45) Date of Patent: Mar. 4, 2008

(54) FLOATABLE SMOKE POT

(75) Inventors: Klaus Sibum, Nonnweiler (DE); Josef Schneider, Neuenburg (DE); Ernest-Christian Koch, Kaiserslautern (DE)

(73) Assignee: Diehl BGT Defence GmbH & Co. KG, Überlingen (DE)

( * ) Notice: Subject to any disclaimer, the term of this patent is extended or adjusted under 35 U.S.C. 154(b) by 198 days.

(21) Appl. No.: 11/346,640

(22) Filed: Feb. 3, 2006

(65) Prior Publication Data

US 2006/0169163 A1 Aug. 3, 2006

(30) Foreign Application Priority Data

Feb. 3, 2005 (DE) ..... 10 2005 004 935

(51) Int. Cl.
*F42B 12/48* (2006.01)
*F42B 5/155* (2006.01)
*C06D 3/00* (2006.01)

(52) U.S. Cl. ..... 102/334; 102/341; 102/367; 441/19

(58) Field of Classification Search ..... 102/334, 102/335, 336, 341, 367, 368, 369, 370; 441/19
See application file for complete search history.

(56) References Cited

U.S. PATENT DOCUMENTS 2,328,916 A * 9/1943 Le Comte ..... 441/19
2,366,261 A * 1/1945 Hitt ..... 441/19
2,978,716 A * 4/1961 Jackson ..... 441/19
3,120,183 A * 2/1964 Wheelwright et al. ..... 102/334
3,427,973 A * 2/1969 Beers ..... 102/334
3,482,517 A * 12/1969 Fleischmann et al. ..... 102/334
3,685,450 A * 8/1972 Walbeck et al. ..... 102/334
3,759,216 A * 9/1973 Sanders et al. ..... 116/210
3,961,259 A * 6/1976 Elstow et al. ..... 455/66.1
4,365,557 A * 12/1982 Couture et al. ..... 102/341

FOREIGN PATENT DOCUMENTS

GB 2354978 A * 4/2001

* cited by examiner

*Primary Examiner*—James S Bergin
(74) *Attorney, Agent, or Firm*—Scully, Scott, Murphy & Presser, P.C.

(57) ABSTRACT

A floatable smoke pot which floats in a stable position with a casing can water-tightly closed by a cover through a closure device. Smoke-generating bodies of a pyrotechnic material, which can be ignited by an igniting device, are arranged in the casing can. A stable floating position is achieve through a ballast weight in the casing can at the can bottom (14). A number of column elements forming the smoke-generating bodies are arranged in the casing can in a uniformly distributed relationship, standing on the ballast weight. The space which remains free of the column elements in the casing can is filled with a buoyancy material. The cover has holes which in the unused original condition of the smoke pot are water-tightly closed with closure elements which can be torn open so that the smoke pot can also be submerged in water for a limited time without extinguishing of the smoke-generating bodies.

14 Claims, 3 Drawing Sheets

FLOATABLE SMOKE POT

BACKGROUND OF THE INVENTION

Field of the Invention

The invention pertains to a floatable smoke pot including a casing can which is water-tightly closed by a cover through the use of a locking device. Smoke-generating bodies constituted of a pyrotechnic material, and which are ignitable by an igniting device are arranged in the casing can.

SUMMARY OF THE INVENTION

The object of the invention is to provide a smoke pot which is capable of floating on water, and which still enables its full output of smoke even after a temporary submersion below the surface of the water and upon again resurfacing thereof.

According to the invention that object is attained by the provision of a ballast weight in the casing can at the can bottom, and wherein a number of column elements forming the smoke-generating column elements in the casing can is filled with a buoyancy material wherein an air volume is present between the cover and the surface of the buoyancy material. The cover is equipped with holes which, in the unused original condition of the smoke pot, are water-tightly closed by closure elements which can be torn apart. Preferred configurations and developments of the floatable smoke pot according to the invention are set forth in the dependent claims.

The smoke pot according to the invention has the advantage that it assumes a stable floating position in the floating condition so that it is capable of affording the full smoke output at any time. It does not go out even during temporary submersion under the surface of the water. The special arrangement of the column elements forming the smoke-generating bodies provides that the smoke pot according to the invention is so stable that the resistance to environmental influences such as mechanical influences due to vibration, shock, fall, and to temperature and moisture influences and so forth, is significantly increased.

The principle according to the invention can also be applied in relation to artillery rockets such as LAR, MLRS and the like.

BRIEF DESCRIPTION OF THE DRAWINGS

Further details, features and advantages will be apparent from the description hereinafter of an embodiment illustrated in the drawings of the smoke pot according to the invention which is floatable, in essence, which floats in a stable condition, wherein.

DETAILED DESCRIPTION OF THE INVENTION

Figure 1:
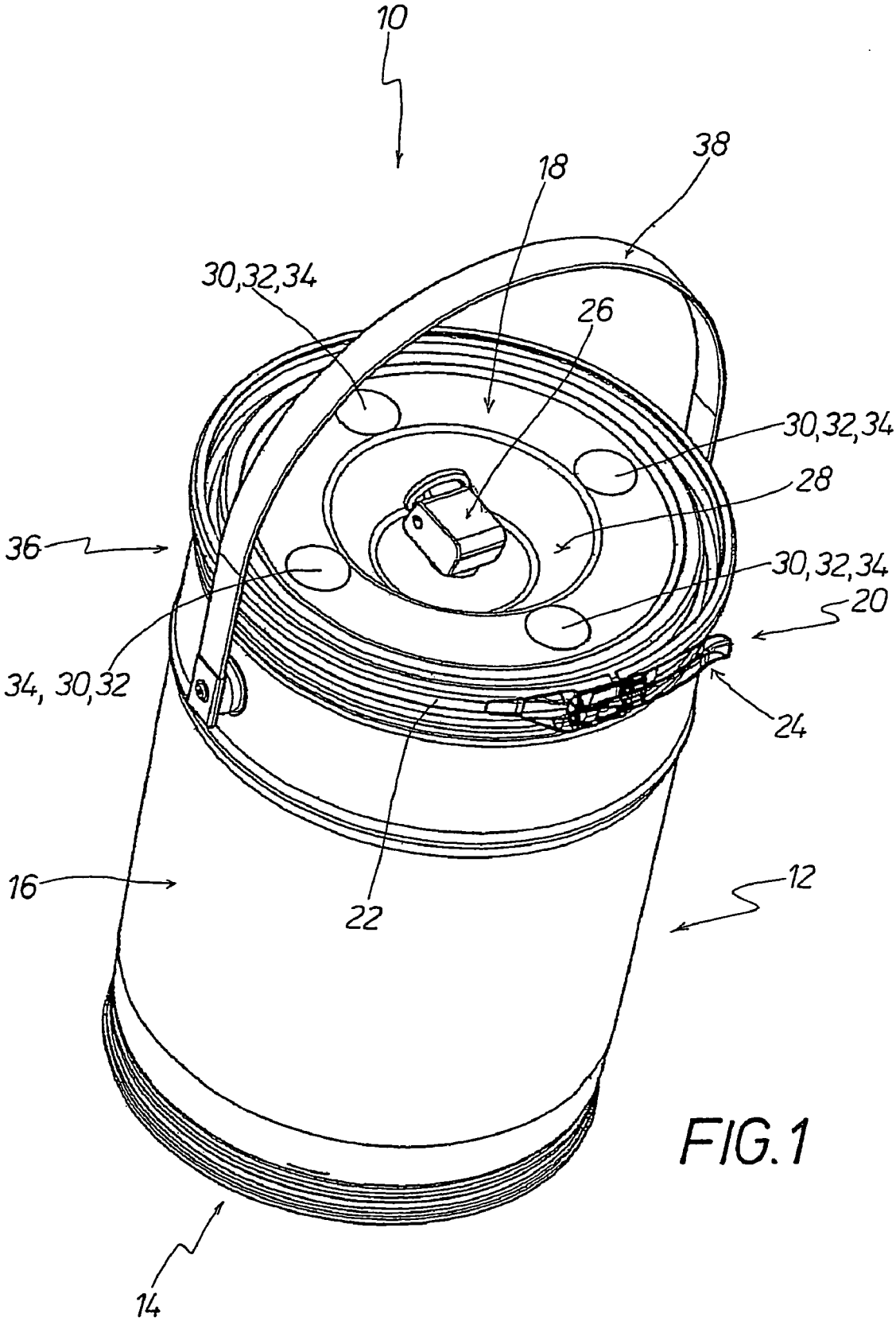
FIG. 1 is a perspective view of the smoke pot, as viewed in an inclined direction from above.

FIG. 1 shows a smoke pot 10 which is floatable, in essence, which floats in a stable condition, in particular for camouflage smoke generation. The smoke pot 10 has a casing can 12 with a can bottom 14 and a peripheral can wall 16 which projects away from the can bottom 14. At its upper end remote from the can bottom 14, the casing can 12 is water-tightly closed by a cover, by means of a locking device 20. The locking device 10 is in the form of a hoop band 22 with a clamping stirrup device 24.

The smoke pot 10 has an igniting device 26 which is mounted to a central recess 28 in the cover 18. The igniting device 26 is formed by a per se known hand grenade fuse.

The cover 18 is provided with holes 30 which are water-tightly closed with closure elements 32 which can be torn open, in the unused original condition of the smoke pot 10. The closure elements 32 are formed by film elements 34.

A gripping handle 38 is fixed to the upper edge 36 of the casing can 12 of the smoke pot 10.

FIG. 2 shows a view from above of the smoke pot 10, with the same details in FIGS. 2 being denoted by the same references as in FIG. 1 so that there is no need for all those features to be described in detail once again with reference to FIG. 2.

Figure 3:
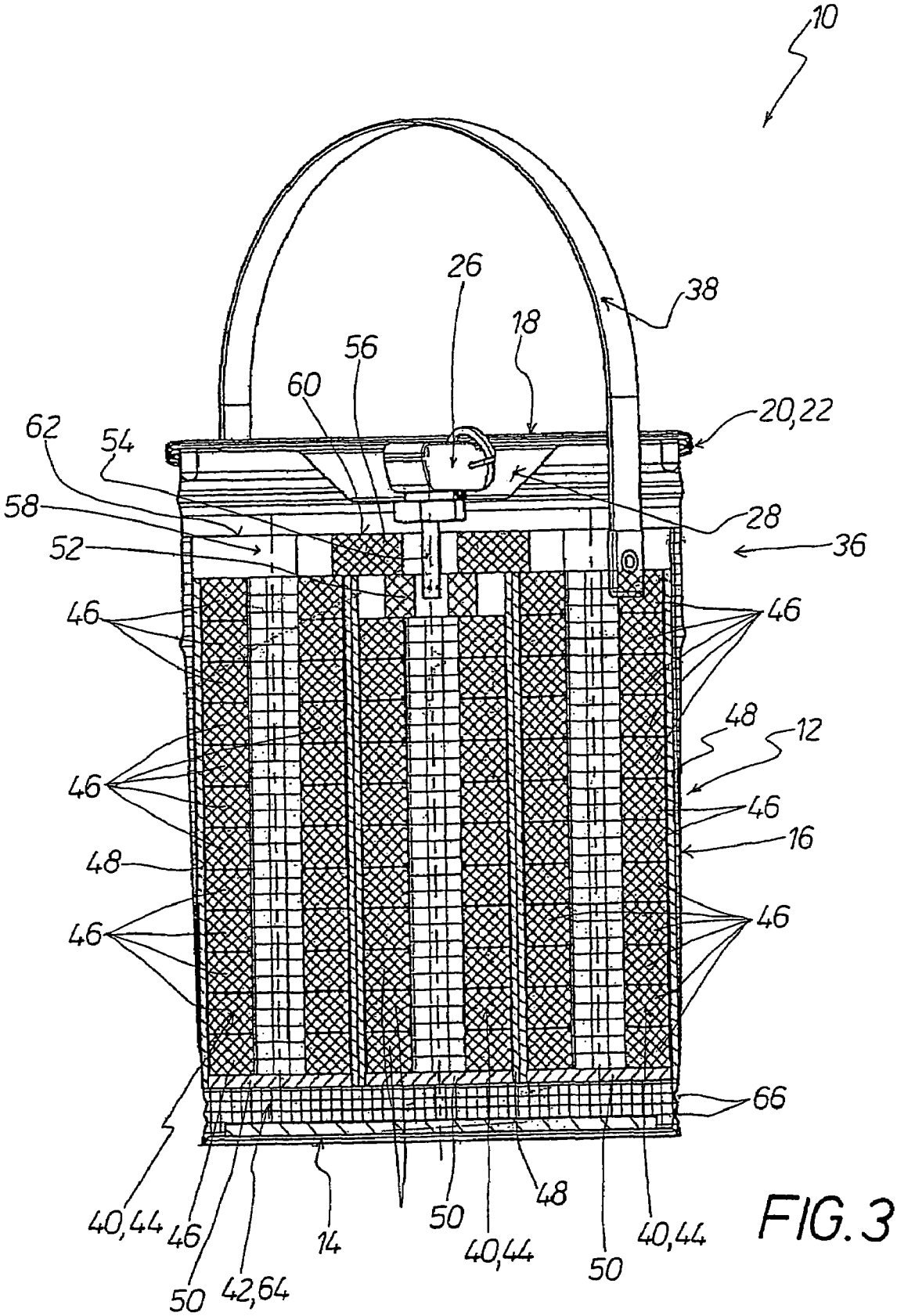
FIG. 3 is a diagrammatic view in longitudinal section of the smoke pot of FIGS. 1 and 2.

FIG. 3 diagrammatically shows a view in longitudinal section of the smoke pot 10. Arranged in the casing can 12 are smoke-generating bodies 40 which are ignitable by the igniting device 26 in order to generate camouflage smoke.

A ballast weight 42 is provided in the casing can 12 at the can bottom 14. The ballast weight 42 provides a stable floating position for the smoke pot 10 in water at any time.

The smoke-generating bodies 40 are formed by column elements 44 arranged standing on the ballast weight 42 in the casing can 12. The column elements 44 each have a number of mutually stacked smoke tablet rings 46 of pyrotechnic, smoke-generating material. The smoke tablet rings 46 of the respective column element 44 are arranged in a tube 48. The respective tube 48 is closed at its underside by means of a closure element 50.

A central column element 44 is arranged in the casing can 12 of the smoke pot 10 and a number of smoke column elements 44 are provided in uniformly distributed concentric relationship around the central column element 44. In the embodiment of the smoke pot 10 shown in the drawing, four edge column elements 44 are provided in uniformly distributed relationship around the central column element 44.

The central column element 44 has at its upper end a smoke tablet ring 52 of reduced inside and outside diameters, into which the igniting device 26 projects with a pyrotechnic delay element 54. A bridging smoke tablet ring 56 lies on the central top-end smoke tablet ring 52 of reduced inside and outside diameters and on the top-end smoke tablet rings 46 of the edge column elements 44 in order to simultaneously ignite all column elements 44 when the igniting device 26 is activated.

The space which remains free of the smoke-generating column elements 44 in the casing can 12 is filled with a buoyancy material formed by a plastic foam. The buoyancy material 58 is introduced into the casing can 12 equipped with the column elements 44, as far as the top side 60 of the bridging smoke tablet ring 56. The surface of the buoyancy material 58 is denoted by reference 62.

The ballast weight 42 is formed by a metal plate 64 which at its outside edge is provided with peripherally extending grooves 66 into which a portion of the peripheral can wall 16 which projects away from the can bottom 14 projects in positively locking relationship in order to fix the ballast weight 42 in the casing can.

Figure 2:
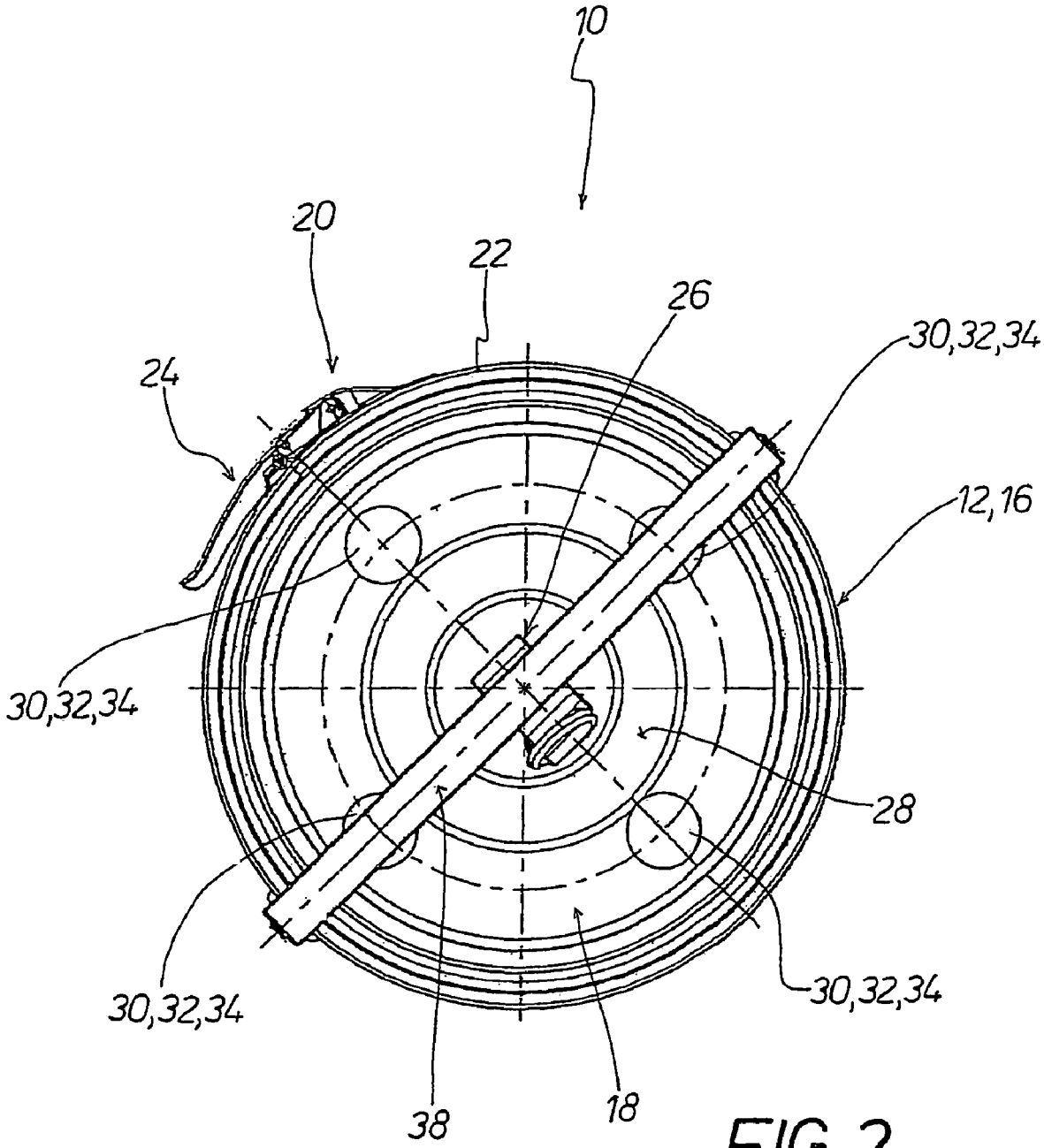
FIG. 2 shows a plan view of the smoke pot of FIG. 1.

Identical features are identified in FIG. 3 by the same references as in FIGS. 1 and 2 so that there is no need for all those features to be described in detail once again with reference to FIG. 3.

LISTS OF REFERENCES

10 smoke pot
12 casing can (of 10)
14 can bottom (of 12)
16 peripheral can wall (of 12)
18 cover (for 12)
20 locking device (for 12 and 18)
22 hoop band (of 20)
24 clamping stirrup device (on 22)
26 igniting device (of 10 for 44 and 52, 56)
28 central recess (in 18)
30 holes (in 18)
32 closure elements which can be torn open (on 30)
34 film element (of 32)
36 upper edge (of 12)
38 gripping handle (of 10 on 36)
40 smoke-generating body (in 12)
42 ballast weight (in 12 on 14)
44 column element (of 40)
46 smoke tablet ring (of 44)
48 tube (for 46)
50 closure element (of 48)
52 smoke tablet ring (at 44)
54 pyrotechnic delay element (of 26)
56 bridging smoke tablet ring (between 52 and 46)
58 buoyancy material (in 12 between 44)
60 top side (of 56)
62 surface (of 58)
64 metal plate (of 42)
66 peripherally extending groove (in 64)

What is claimed is:

1. A floatable smoke pot comprising a casing can which is water-tightly closed by a cover by a locking device, including smoke-generating bodies of a pyrotechnic material which are ignitable by an igniting device being arranged in the casing can; a ballast weight being provided in the casing can at a can bottom, a number of column elements forming the smoke-generating bodies being arranged in the casing can in a uniformly distributed relationship standing supported on the ballast weight; a space which remains free from the smoke-generating column elements in the casing can being filled with a buoyancy material, and providing an air volume between the cover and the facing surface of the buoyancy material; and said cover being equipped with holes which, in the unused original condition of the smoke pot, are water-tightly closed by tearable closure elements.

2. A floatable smoke pot according to claim 1, wherein the ballast weight is formed by a metal plate which is fastened in the casing can.

3. A floatable smoke pot according to claim 2, wherein the metal plate has at least one peripherally extending groove along the outer edge thereof, and wherein a portion of the peripheral can wall which projects away from the can bottom projects into the groove in a positive locking relationship.

4. A floatable smoke pot according to claim 1, wherein each respective said column element comprises a number of mutually stacked smoke tablet rings constituted of said pyrotechnic material, and which are arranged in a tube.

5. A floatable smoke pot according to claim 4, wherein each said tube comprises a cardboard material.

6. A floatable smoke pot according to claim 4, wherein each said tube is closed at a lower end thereof by a closure element.

7. A floatable smoke pot according to claim 1, wherein a central column element is provided in the casing can, and a number of edge column elements are provided in the casing can in a uniformly distributed concentric relationship around the central column element.

8. A floatable smoke pot according to claim 7, wherein the edge column elements each include smoke tablet rings possessing identical configurations.

9. A floatable smoke pot according to claim 7, wherein at an upper end the central column element includes a smoke tablet ring of reduced inside and outside diameters, into which the igniting device projects with a pyrotechnic delay element.

10. A floatable smoke pot according to claim 9, wherein a bridging smoke tablet ring rests on the central smoke tablet ring of reduced inside and outside diameter and on the top smoke tablet rings of the edge column elements.

11. A floatable smoke pot according to claim 10, wherein the space in the casing can, which is free of the smoke-generating column elements (44), is filled with the buoyancy material up to the top side of the bridging smoke tablet ring (56).

12. A floatable smoke pot according to claim 11, wherein the buoyancy material is formed by a plastic foam.

13. A floatable smoke pot according to claim 7, wherein the holes in the cover are provided in an axially aligned relationship with the edge column elements and wherein the closure elements for the holes are formed by tearable film elements.

14. A floatable smoke pot according to claim 1, wherein the igniting device is formed by a hand grenade fuse which is mounted in a central recess in the cover.

* * * * *